US009848688B2

(12) United States Patent
Davis

(10) Patent No.: US 9,848,688 B2
(45) Date of Patent: Dec. 26, 2017

(54) TOOL BELT WITH NON-SCRATCH BUCKLE COVER

(71) Applicant: Kevin B. Davis, Belgrade, MT (US)

(72) Inventor: Kevin B. Davis, Belgrade, MT (US)

( * ) Notice: Subject to any disclaimer, the term of this patent is extended or adjusted under 35 U.S.C. 154(b) by 33 days.

(21) Appl. No.: 14/926,934

(22) Filed: Oct. 29, 2015

(65) Prior Publication Data

US 2016/0120293 A1 May 5, 2016

Related U.S. Application Data

(60) Provisional application No. 62/072,753, filed on Oct. 30, 2014, provisional application No. 62/161,989, filed on May 15, 2015.

(51) Int. Cl.

| | |
|---|---|
| ***A45F 3/14*** | (2006.01) |
| ***B25H 3/00*** | (2006.01) |
| *A45F 5/00* | (2006.01) |

(52) U.S. Cl.

CPC ..... *A45F 3/14* (2013.01); *B25H 3/00* (2013.01); *A45F 5/00* (2013.01); *A45F 2003/144* (2013.01); *A45F 2200/0575* (2013.01)

(58) Field of Classification Search

CPC ..... Y10S 224/904; A45F 2003/144; A45F 2200/0575; A45F 2003/008; A45F 3/14; A45F 5/021

USPC ..... 224/904, 660, 662–663, 677

See application file for complete search history.

(56) References Cited

U.S. PATENT DOCUMENTS

| | | | | |
|---|---|---|---|---|
| 4,923,105 | A * | 5/1990 | Snyder | A45F 3/14 224/232 |
| D387,887 | S | 12/1997 | Jensen | |
| 5,884,382 | A | 3/1999 | Hansen | |
| 6,398,092 | B1 * | 6/2002 | Ansley | A45F 5/02 224/582 |
| 6,463,637 | B1 | 10/2002 | Carnahan | |
| D653,017 | S * | 1/2012 | Hamlin | D11/200 |
| 2004/0103949 | A1 * | 6/2004 | Rickards | F16L 57/00 138/158 |

(Continued)

FOREIGN PATENT DOCUMENTS

JP 3172982 U * 1/2012

OTHER PUBLICATIONS

Http://www.wonderguards.net, last visited Jun. 22-Jun. 23, 2014 via the Wayback Machine Internet Archive.*

*Primary Examiner* — Scott McNurlen
(74) *Attorney, Agent, or Firm* — Gardner, Linn, Burkhart & Flory, LLP

(57) ABSTRACT

A non-scratch tool belt apparatus conveniently contains instruments that are useful for a task adjacent to a user, such as for detailing operations of objects that have delicate surfaces or finishes. The tool belt apparatus is lightweight and generally features only soft exposed materials, such as cotton. The tool belt reduces the likelihood that users will lose an instrument, and also of scratching a surface. The apparatus includes an elongated fabric belt, a buckle, a non-scratch buckle cover, and a plurality of tool bags. The elongated fabric belt wraps around a user and is secured by the buckle. The buckle cover encloses the buckle to prevent scratching. The buckle cover and plurality of tool bags can slide on the belt. The tool bags are each configured to hold at least one instrument, such as a tool or bottle used in detailing operations.

5 Claims, 2 Drawing Sheets

(56) References Cited

U.S. PATENT DOCUMENTS

| | | | | |
|---|---|---|---|---|
| 2005/0040200 | A1* | 2/2005 | Shen | A45F 5/02<br>224/670 |
| 2012/0024917 | A1* | 2/2012 | Case | A45F 3/02<br>224/259 |
| 2014/0361063 | A1* | 12/2014 | Reed | A45F 5/021<br>224/682 |

* cited by examiner

TOOL BELT WITH NON-SCRATCH BUCKLE COVER

CROSS REFERENCE TO RELATED APPLICATIONS

The present application claims the benefit of U.S. provisional application Ser. No. 62/161,989, filed May 5, 2015, and also U.S. provisional application Ser. No. 62/072,753, filed Oct. 30, 2014, hereby incorporated by reference in their entirety.

FIELD OF THE INVENTION

The present invention relates to utility belts for cleaning and maintenance tasks.

BACKGROUND OF THE INVENTION

A user may perform many tasks while detailing large vehicles such as automobiles, boats, or aircraft, or while cleaning or polishing fine furniture, pianos, or the like. For example, a user may be required to dust, rinse, wash, polish, buff, and wipe a vehicle repeatedly and in various order of operations. In addition, the user is generally under a time restriction to perform all of the tasks to finish other vehicles in queue. Each task generally requires specific tools and instruments. Thus, the user is generally constantly picking up and putting down tools and instruments between tasks, which increases the total detailing time, the risk of losing tools and instruments, and the likelihood that the user may scratch the surface of the vehicle, fine furniture, or the like. Generally, heavy belts like construction belts cause users to fatigue quickly, which may discourage use of the belt, increase time to finish tasks, and increase the risk of damage.

SUMMARY OF THE INVENTION

The present invention provides a tool belt that is configured to conveniently contain instruments adjacent to the user that are useful for a task, such as cleaning and polishing vehicles or other objects. According to an aspect of the present invention, the tool belt includes an elongated fabric belt, a buckle, a non-scratch buckle cover, and a plurality of tool bags. The tool belt reduces the likelihood that the user will lose an instrument, while also reducing the likelihood that the user will scratch a vehicle's surface with the instrument or with the belt itself, or trip over the instrument.

The elongated fabric belt is configured to wrap around a waist of the user and be secured by the buckle. The non-scratch buckle cover encloses the buckle when secured around the waist of the user. The buckle cover is slidably disposable on the belt so the user may clip and unclip the buckle when the buckle cover is slid away from the buckle. The tool belt also features a variety of tool bag sizes so that the user may accommodate substantially any required instrument such as a detailing tool or bottle. Each of the tool bags is configured to hold one or more instruments. In addition, each of the tool bags is slidably disposed on the belt and removable from the belt, so the user may customize the tool belt according to the needs of the task and the user's preferences.

The tool belt is lightweight, preferably less than one pound when empty to prevent fatigue and promote use of the tool belt. The tool belt generally features only exposed materials that are soft (such as cotton) rather than hard materials (such as hard plastics or metal) that could scratch or scuff painted surfaces, wood, or other delicate surfaces. In some embodiments that do have hard materials that could scratch or scuff other surfaces, the tool belt includes a soft cover, such as the buckle cover, to prevent the hard material portions from scratching finished or delicate surfaces.

Thus, the lightweight tool belt conveniently contains instruments adjacent to the user to decrease the time to perform tasks and reduce the likelihood that user will lose the instruments. Furthermore, the tool belt reduces the likelihood that the user will scratch finished or delicate surfaces, such as on vehicles, fine furniture, or the like.

These and other objects, advantages, purposes and features of this invention will become apparent upon review of the following specification in conjunction with the drawings.

DESCRIPTION OF THE PREFERRED EMBODIMENTS

Figure 1:
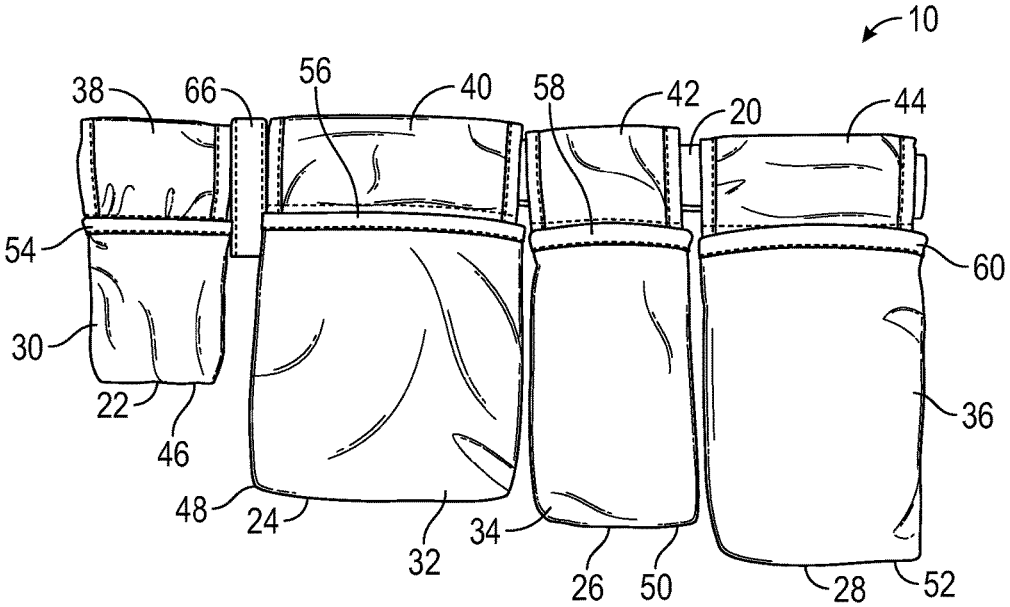
FIG. 1 is a front view of a tool belt with tool bags and a utility loop assembled on a fabric belt, in accordance with the present invention.
Figure 2:
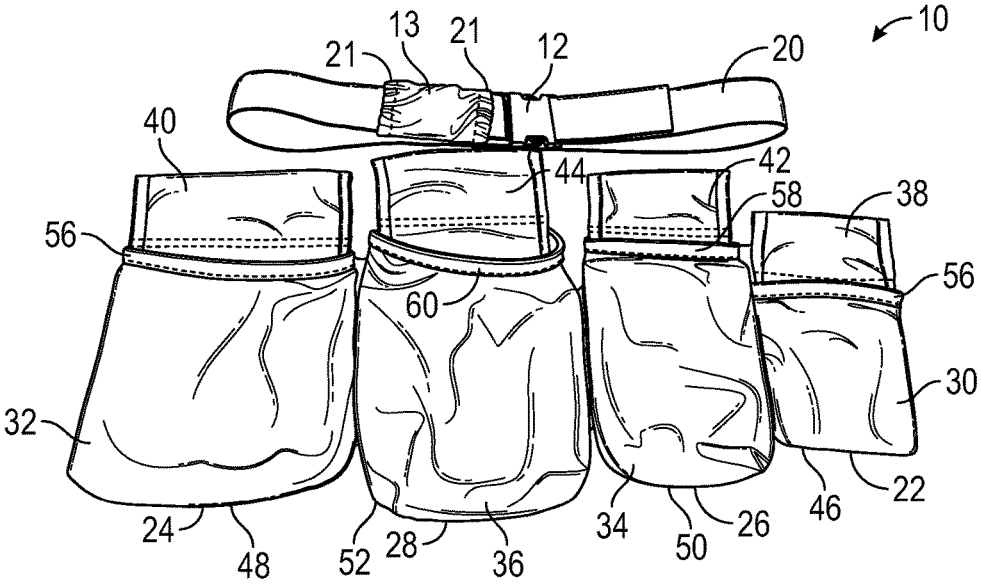
FIG. 2 is a front view of the tool bags and belt of FIG. 1, shown disassembled with a buckle cover not covering the clipped buckle.

Referring now to the drawings and illustrated embodiments therein, a tool belt 10 includes a belt closure in the form of a buckle 12 selectively covered by a movable non-scratch buckle cover 13, and further includes a first or male buckle connector 14, a second or female buckle connector 16, and an elongated fabric belt 20 that supports a plurality of tool attachments, such as tool bags 22, 24, 26, 28 as shown in FIGS. 1 and 2, for containing instruments that are useful for tasks such as cleaning and polishing vehicles and fine furniture. Specifically, the tool belt 10 is a waist belt secured around the waist of a user to contain instruments within hand's reach during a task. The user can remove and replace instruments in the tool belt 10 as needed to perform each task, with reduced risk of scratching finished and delicate surfaces, such as a vehicle exterior or fine furniture.

The belt 20 is formed of a lightweight and durable material that generally has a lower hardness than common finished or delicate surfaces, for example a vehicle's exterior painted or gel-coated finish, such that the belt 20 is unlikely to scratch finished and delicate surfaces when rubbed against them. The belt 20 is lightweight to substantially avoid fatiguing the user during tasks. However, the belt 20 is sufficiently durable to not fray or break while containing the weight of the instruments and rubbing against finished or delicate surfaces. For example, belt 20 may be made of woven nylon, although other materials like cotton, polyester, leather, or the like may be used.

Figure 3:
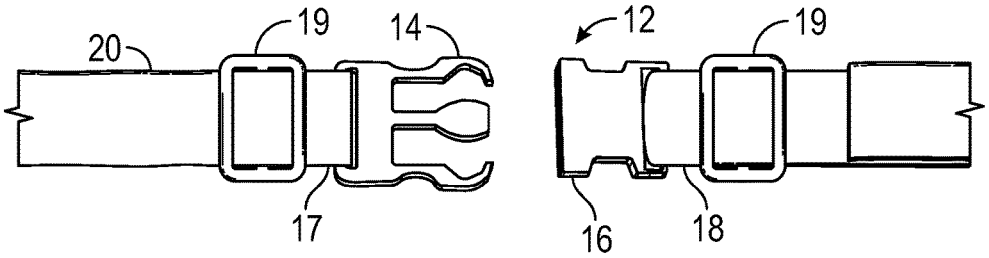
FIG. 3 is a front view of the buckle of FIG. 2 shown in an unclipped position.

Referring now to FIG. 3, the belt 20 has a first end portion 17 attached to male connector 14 of the buckle 12 and a second end portion 18 attached to female connector 16 of the buckle 12. The male connector 14 is configured to engage the female connector 16 to releasably secure the tool belt 10 around the waist of the user. When the tool belt 10 is secured to the user, an inner side of the buckle 12 is adjacent to the waist of the user and an outer side of the buckle 12 is facing away from the user. Preferably, the buckle 12 is made of a durable non-scratch material such as plastic or nylon. The buckle 12 is generally any type of lightweight and durable buckle, such as a side release clip buckle shown in FIGS. 2, 3, and 5. However, one would appreciate that many types of buckles may be used, such as center bar buckles, horse blanket buckles, or the like. It will further be appreciated that hook-and-loop fasteners may be used in place of traditional buckles by, for example, overlapping a hook portion that is attached to the first end portion 17 on a loop portion that is attached to the second end portion 18, or vice versa, and tightly pressing the hook portion against the loop portion to secure the fastener.

Figure 4:
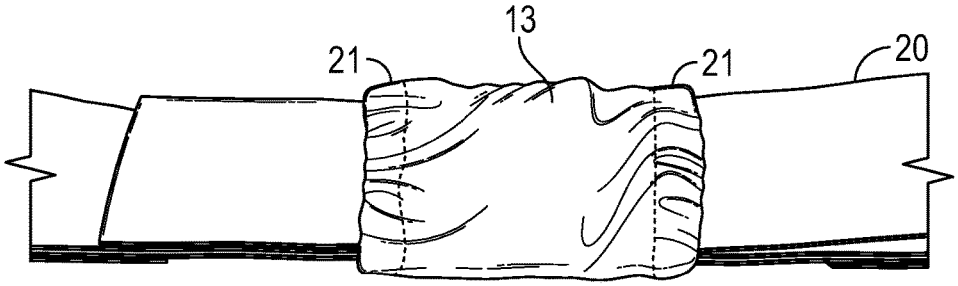
FIG. 4 is a front view of the buckle cover of FIG. 2, shown covering the buckle in a clipped position.

The non-scratch buckle cover 13 is configured to partially enclose the buckle 12 (e.g. the outer side) and may optionally leave the inner side of the buckle 12 partially uncovered. FIG. 4 illustrates the buckle cover 13 covering the outer side of the buckle 12 when the male connector 14 and the female connector 16 are engaged, such as when the tool belt 10 is on the user's waist. However, the buckle cover 13 can be moved away from buckle 12 and generally disposed anywhere on the belt 20, or between buckle 12 and the nearest tool bag 22, 24, 26, or 28 (see FIGS. 2 and 5), when the tool belt 10 is unsecured or secured to the user. The belt 20 also retains the buckle cover 13 when the belt 20 is not secured to the user to reduce the risk of losing the buckle cover 13. When the belt 20 is secured on the user, the user repositions the buckle cover 13 on the belt 20 by pulling the buckle cover 13 along the belt 20 until it is positioned over the buckle 12. When the belt 20 is secured to the user, the user may reposition the buckle cover 13 to expose and unclip the buckle 12. The user may also vary the length of the belt 20 by tightening or loosening a slide adjuster 19 near each of the male connector 14 and female connector 16 (see FIG. 3). Thus, the buckle cover 13 is slidably disposable on the belt 20 to cover and uncover the buckle 12, and may be sufficiently long to also cover the slide adjusters 19 as desired.

The buckle cover 13 is configured to not scratch a finished or delicate surface, such as a vehicle or fine furniture surface, when the belt 20 is secured on the user. Thus, the buckle cover 13 is generally made of a soft non-scratch material and has a generally tubular shape. In the illustrated embodiment, the buckle cover 13 is formed by connecting opposing ends of a generally rectangular piece of fabric into a generally tubular shape. For example, the buckle cover 13 may be formed by sewing opposing ends of the fabric to each other. However, the buckle cover 13 may be formed by other methods, such as gluing fabric, sewing multiple ends, or forming the buckle cover 13 from a tubular knit fabric.

Figure 5:
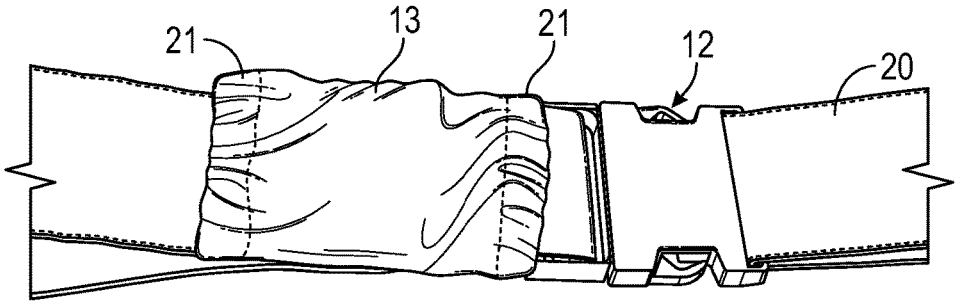
FIG. 5 is a front view of the buckle cover and buckle of FIG. 2 shown in a clipped position.

The buckle cover 13 in the illustrated embodiment partially form-fits to the buckle 12 by incorporating elastic fibers or an elastic element into the fabric material of the buckle cover 13. Form-fitting the buckle cover 13 to the buckle 12 reduces the likelihood that buckle cover 13 will unintentionally or undesirably move from its desired position, such as covering the buckle 12 and slide adjuster 19 when the belt 20 is secured to the user. FIGS. 4 and 5 illustrate the buckle cover 13 with elastic bands 21 at each end to form-fit or constrict the buckle cover 13 around the buckle 12 and/or belt 20. Each elastic band 21 is sewn into the buckle cover 13, for example, by positioning the band 21 into a fold at an end of the buckle cover 13 and sewing the fold to form a tubular or annular pocket such that the elastic band 21 remains in the pocket. However, the buckle cover 13 may include more than two elastic bands 21, or the buckle cover 13 may also be formed of an elastic material such as elastane or the like.

Referring again to FIGS. 1 and 2, each of the plurality of tool bags 22, 24, 26, 28 are configured to contain instruments that are useful during the user's tasks. Each tool bag 22, 24, 26, 28 is slidably movable along (and supported on) the belt 20 by a respective attachment portion 38, 40, 42, 44 that is coupled to a respective container portion 30, 32, 34, 36 that is arranged to hang below each respective attachment portion 38, 40, 42, 44 (FIGS. 1 and 2). Each container portion 30, 32, 34, 36 holds an instrument or tool for the user's tasks. In the illustrated embodiment, tool bag 28 is configured to contain the instrument, tool, or bottle that has a volume of approximately 32-48 ounces, tool bag 26 is configured to contain the instrument, tool, or bottle that has a volume of approximately 16-32 ounces, tool bag 24 is configured to contain the instrument, tool, or bottle that has a volume of approximately 36-52 ounces, and tool bag 22 is configured to contain miscellaneous small tools, cards, mobile phones, or the like. For example, each of the instruments, tools, or bottles may be useful for detailing automobiles, such as polishing and cleaning compounds, wash pads, and towels. Thus, each tool bag 22, 24, 26, 28 has a volume and shape to contain a desired instrument. Each container portion 30, 32, 34, 36 of the illustrated embodiment is generally rectangular, although each container portion 30, 32, 34, 36 may be generally rounded.

Each of the attachment portions 38, 40, 42, 44 slidably couples to the belt 20, is repositionable along the belt 20, and is removable from the belt 20. FIG. 1 illustrates tool bag 22 adjacent to tool bag 24 and opposite tool bag 28. However, each of the tool bags 22, 24, 26, 28 may be arranged on belt 20 according to each task and the user's preferences, and the user may select which tool bags to position along the belt 20 for a given task. For example, tool bag 28 may be adjacent to tool bag 24 and opposite tool bag 22 along the belt. Furthermore, the tool belt 10 may use bags with alternative sizes, shapes, and relative positions on the belt 20. Thus, the tool belt 10 is customizable according to the task's needs and the user's preferences.

Each bag 22, 24, 26, 28 is formed of a lightweight, non-scratch material. For example, the bags 22, 24, 26, 28 of the illustrated embodiment may be formed of cotton, although other materials such as nylon, polyester, leather, and blends thereof may be equally suitable. Each container portion 30, 32, 34, 36 has respective open ends 54, 56, 58, 60 that are adjacent to respective attachment portions 38, 40, 42, 44, and a respective closed end 46, 48, 50, 52 that is opposite and below the respective attachment portions 38, 40, 42, 44. The attachment portions 38, 40, 42, 44 are generally made of single sheets of fabric having upper portions folded down and sewn across their widths (i.e. horizontally) into a loop-like shape to form the attachment portions 38, 40, 42, 44, and having lower portions folded up and sewn along their respective side edges (i.e. vertically) while leaving open ends 54, 56, 58, 60 unsewn. In an alternative embodiment, the loop-like shape of the attachment portions 38, 40, 42, 44 is held closed by a hook-and-loop fastener, such as Velcro®.

The attachment portions 38, 40, 42, 44 and open ends 54, 56, 58, 60 of each bag 22, 24, 26, 28 are sewn by hand or using a mechanical sewer to be durable and lightweight. Optionally, each bag 22, 24, 26, 28 may have cotton seam tape to cover rough seams that could scratch finished or delicate surfaces, and may have a flexible nylon tube or rod sewn into the fabric of the container portions 30, 32, 34, 36 proximate to the open ends 54, 56, 58, 60 to hold the container portions 30, 32, 34, 36 open to assist the user's access to instruments in the bags 22, 24, 26, 28. The attachment portions 38, 40, 42, 44 and the container portion 30, 32, 34, 36 may be formed from a single piece of fabric that is folded and sewn closed. Alternatively, each attachment portion 38, 40, 42, 44 and container portion 30, 32, 34, 36 may be formed from one piece of fabric that is folded and sewn closed to form the loop-like shape of the attachment portions, 38, 40, 42, 44 and at least a part of a back panel of the container portions 30, 32, 34, 36. Each back panel is then sewn to another panel that forms at least a front (and optionally also at least part of the back) of each container portion 30, 32, 34, 36. Thus, each bag 22, 24, 26, 28 is constructed to be lightweight, durable, and non-scratching.

Referring again to FIG. 1, the tool belt 10 also has an optional utility loop 66 disposed on belt 20 between tool bag 22 and tool bag 24. The utility loop 66 is a tool attachment configured to hold various objects, particularly with elongated dimensions like extension and power cords for electrical buffers, or for rags, towels, or other hangable tools, to increase the user's ease of access to the objects, prevent loss of the objects, and reduce the likelihood that the objects interfere with the user during the tasks. The utility loop 66 of the illustrated embodiment has a circumference of six to nine inches, although the loop may have other sizes according to the user's needs. The utility loop 66 is generally formed of cotton or a cotton-nylon material, for example, to be lightweight, durable, and non-scratching. The utility loop 66 may include a hook-and-loop fastener, such as Velcro®, that fastens when the loop 66 is in position around the belt 20 with the desired objects, such as extension cords, in the loop 66. Like the tool bags 22, 24, 26, 28, the utility loop 66 is slidably displaceable along belt 20 according to the needs of the tasks and the user's preferences.

Thus, the lightweight tool belt 10 conveniently holds instruments adjacent to the user. The tool belt 10 reduces the likelihood that the user will lose an instrument, while also reducing the likelihood that the user will scratch a finished or delicate surface or trip over the instrument. The tool bags 22, 24, 26, 28 are customizable and hold the instrument such as substantially any common detailing tool or bottle. The non-scratch buckle cover 13 encloses the buckle 12 and any other non-fabric portions of the tool belt 10, such as slide adjuster 19, when the tool belt 10 is secured around the waist of the user. Therefore, the tool belt 10 aids the user in performing required tasks faster and without scratching or marring surfaces.

Changes and modifications in the specifically described embodiments can be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A tool belt apparatus comprising:

an elongated fabric belt formed of a non-scratch material having a first end portion and a second end portion, wherein said fabric belt is configured to wrap around a waist of a user;

a buckle formed of a first connector at said first end portion of said belt and a second connector at said second end portion of said belt, wherein said first connector is configured to releasably engage said second connector, said buckle having an inner side that is adjacent to the waist of the user and an outer side that is opposite said inner side;

a utility loop that is removably and slidably attached to said fabric belt such that said utility loop is repositionable along said fabric belt, wherein said utility loop is configured to support an instrument by encircling said fabric belt and the instrument;

a slide adjuster disposed along said belt and spaced from said buckle by a portion of said belt, said slide adjuster configured to adjust the length of said belt;

a non-scratch buckle cover removably and slidably disposed along said belt and configured to selectively enclose said inner side and said outer side of said buckle, and said slide adjuster, when said first connector and second connector are engaged, said buckle cover at least partially formed of an elastic material to tightly encircle said inner side and said outer side of said buckle; and a plurality of tool bags formed of non-scratch fabric, wherein each of said tool bags is slidably repositionable and removable from said belt and includes an attachment portion and a container portion, wherein said container portion is configured to hold at least one instrument and said attachment portion attaches to said belt;

wherein said non-scratch buckle cover comprises tubular pockets formed at opposite ends thereof, and wherein elastic material is positioned in each of said tubular pockets to thereby constrict said non-scratch buckle cover at opposite sides of said buckle.

2. The tool belt apparatus of claim 1, wherein said utility loop is configured to support an electrical cable or a towel.

3. The tool belt apparatus of claim 1, wherein, each said container portion of each tool bag is disposed below said attachment portion of each tool bag, and each said container portion has a closed end and an open end that is adjacent to said attachment portion.

4. The tool belt apparatus of claim 1, wherein for each of said tool bags said attachment portion and said container portion are formed by sewing a single sheet of fabric.

5. The tool belt apparatus of claim 1, wherein said plurality of tool bags are formed of woven fabric.

* * * * *